United States Patent [19]

Clegg

[11] Patent Number: 4,577,349

[45] Date of Patent: Mar. 25, 1986

[54] SINK OUTLET VALVE

[76] Inventor: John E. Clegg, 2320 Keystone Dr., Orlando, Fla. 32806

[21] Appl. No.: 737,832

[22] Filed: May 28, 1985

[51] Int. Cl.[4] ..... E03C 1/23

[52] U.S. Cl. ..... 4/203; 4/287; 4/295

[58] Field of Search ..... 4/286–292, 4/197–204, 295

[56] References Cited

U.S. PATENT DOCUMENTS

| | | | |
|---|---|---|---|
| 568,261 | 9/1896 | Lewis | 4/200 |
| 641,126 | 1/1900 | Lewis | 4/200 |
| 679,882 | 8/1901 | Bunting | 4/200 |
| 1,613,251 | 1/1927 | Stead | 4/295 |
| 1,848,521 | 3/1932 | Fleck | 4/203 |
| 2,697,840 | 12/1954 | Steele | 4/203 |
| 3,646,619 | 3/1972 | Rokitenetz | 4/203 |

FOREIGN PATENT DOCUMENTS

| | | | |
|---|---|---|---|
| 735617 | 11/1932 | France | 4/200 |
| 34439 | 4/1911 | Sweden | 4/295 |

*Primary Examiner*—Charles E. Phillips

[57] ABSTRACT

An outlet valve comprising a vertical outlet tube mounted inside a fixed tubular casing, a horizontal yoke engaging a collar encircling the fixed tubular casing, and a vertical rod which is revolved to move the yoke in the horizontal plane as means of revolving the collar to lower the outlet tube to the closed position or to raise the outlet tube to the open position. The outlet tube is lowered and raised by the movement of a cam pin in cam slots in the outlet tube and fixed casing.

1 Claim, 4 Drawing Figures

SINK OUTLET VALVE

BACKGROUND

Prior art includes the three patents described below;

1. Washbasin, U.S. Pat. No 679,882 by Bunting. This washbasin features a stopper with a vertical plate mounted inside a fixed sleeve. The stopper is lowered (closed) and raised (opened) by a push rod which is inserted into an inclined slot in the vertical plate. The push rod is operated by a crank which is revolved by a vertical plunger rod.

2. Fitting, U.S. Pat. No. 1,848,521 by Fleck. This washbasin features a sleeve and stopper which are raised and lowered by a lever which is operated by a vertical screw rod.

3. Waste And Overflow Fitting, U.S. Pat. No. 2,697,840 by Steele. This fitting features a horizontal shaft with a raised knuckle bend which engages a horizontal slot in a tubular valve. The valve is raised and lowered by revolving the shaft.

SUMMARY

The sink outlet valve disclosed herein has three features which render it original and distinct from the patents of prior art described above, as follows;

1. The means of shutting off flow is an O-ring which can be readily removed and replaced. (The valve on which the O-ring is mounted can be lifted out of its casing.)

2. A revolving cam mechanism is used to lower and raise the valve.

3. The revolving cam mechanism is operated by a horizontal yoke.

DRAWINGS

DESCRIPTION

Figure 1:
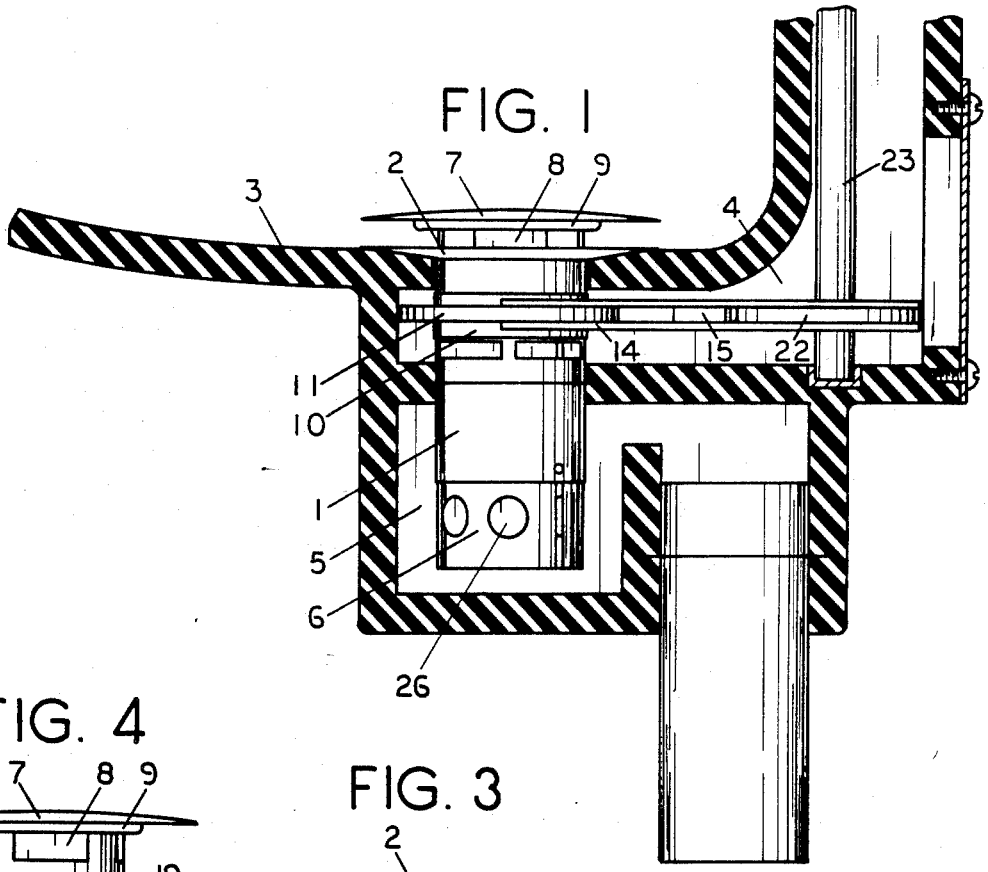
FIG. 1 is an elevation of the sink outlet valve in open position.
Figure 4:
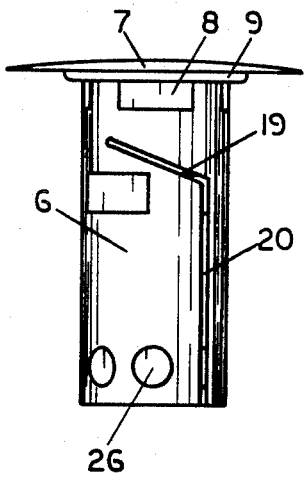
FIG. 4 is an elevation of the tubular outlet valve.

FIG. 1 is an elevation of the sink outlet valve showing vertical fixed tubular casing 1 with top flange 2 installed in basin 3. Casing 1 extends down through overflow chamber 4 and terminates in retention chamber 5.

Tubular outlet valve 6 with circular plate 7 is mounted in casing 1. The water flows from basin 3 into valve 6 through four inlet ports 8 arranged in a circle in the wall of valve 6.

An O-ring 9 secured to the bottom of plate 7 makes contact with the top of casing flange 2 and shuts off the flow of water when valve 6 is lowered in casing 1.

Valve 6 is a lift-out debris trap which can be removed from casing 1 for emptying and cleaning as disclosed in a copending application entitled Lift-Out Drain Trap, Ser. No. 737,831, filed May 28, 1985, now abandoned. Valve 5 can be removed also for the replacement of O-ring 9.

Figure 2:
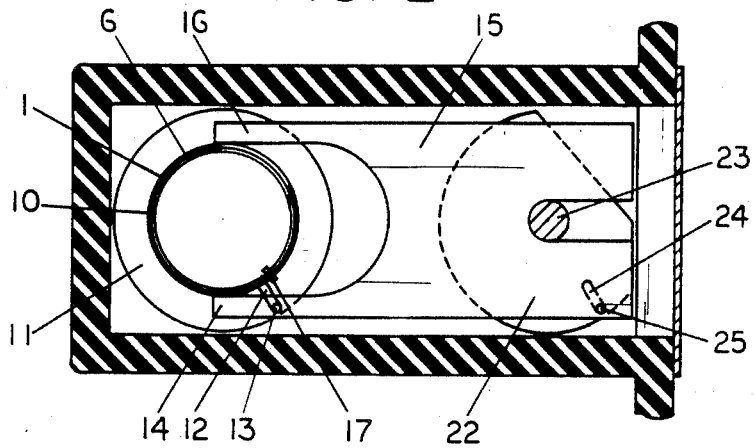
FIG. 2 is a plan view of the horizontal yoke, revolving collar, flange, revolving crank disk, vertical operating rod and other parts.

Revolving collar 10 is mounted on casing 1 and is attached to flange 11 (FIG. 2). Slot 12 in flange 11 engages crank pin 13 in arm 14 of horizontal yoke 15 and serves as means of revolving collar 10 when linear movement is applied to yoke 15. Arm 14 is opposite and parallel to arm 16. The arms serve as means of maintaining alignment of yoke 15.

Figure 3:
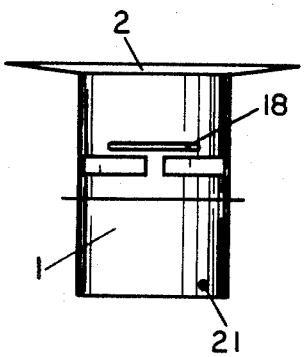
FIG. 3 is an elevation of the fixed tubular casing.

Cam pin 17 is secured in collar 10 and projects through horizontal slot 18 in casing 1 (FIG. 3) to engage inclined cam slot 19 in valve 6. Cam pin 17 is the means of lowering (closing) and raising (opening) valve 6 when collar 10 is revolved.

Valve 6 is prevented from revolving by vertical slot 20 which engages pin 21 in casing 1.

Linear movement is applied to yoke 15 by revolving crank disk 22 which is attached to vertical operating rod 23. Slot 24 in disk 22 engages crank pin 25 in yoke 15 and imparts linear movement to the yoke.

Water is discharged from valve 6 through outlet ports 26.

I claim:

1. A basin outlet valve comprising a vertical fixed tubular casing having a circular top flange, a tubular walled outlet valve having a circular plate attached to the top of said tubular portion with said tubular portion mounted inside said casing, a vertical operating rod having a revolving crank disk attached to the bottom thereof, a revolving collar encircling the upper portion of said casing, a horizontal yoke having two opposed arms, said yoke being mounted between said crank disk and said revolving collar, a series of four inlet ports arranged in a circle in said wall of said valve to allow water to flow from said basin into said valve, an O-ring secured to said valve below said plate to make contact with an upper surface of said flange and serving as means of shutting off the flow of water when said valve is lowered in said casing, a flange having a slot therein, said flange being secured to said collar and communicating with at least one of said arms of said yoke via a crank pin attached to said one of said arms, said pin engaging said slot in said flange and serving as a means of revolving said collar when linear movement is applied to said yoke, a horizontal slot in said casing, an inclined cam slot in said valve adjacent to said horizontal slot, a cam pin secured through said collar and projecting through said horizontal slot in said casing to engage said inclined cam slot and serving as a means of lowering and raising said valve with respect to said casing when said collar is revolved, a pin secured in said casing, a vertical slot in said valve engaging said pin in said casing and serving as a means of preventing said valve from revolving with respect to said casing while allowing said valve to be disengaged from said casing by lifting, a slot in said revolving crank disk, and a crank pin in said yoke engaging said disk slot and serving as a means of imparting linear movement to said yoke when said operating rod is revolved, which movement further imparts rotation to said collar via said crank pin and flange slot, which rotation further causes said cam pin to force said valve open or closed by contact with said cam slot.

* * * * *